US010473382B2

(12) United States Patent
Grenier et al.

(10) Patent No.: US 10,473,382 B2
(45) Date of Patent: Nov. 12, 2019

(54) INSULATED DOOR AND REFRIGERATOR DOOR SYSTEM INCLUDING THE INSULATED DOOR

(71) Applicant: EDC Energy Door Company, L'assomption (CA)

(72) Inventors: Mathieu Grenier, Repentigny (CA); Vincent Cormier, Repentigny (CA)

(73) Assignee: EDC ENERGY DOOR COMPANY, L'Assomption (CA)

( * ) Notice: Subject to any disclaimer, the term of this patent is extended or adjusted under 35 U.S.C. 154(b) by 0 days.

(21) Appl. No.: 16/178,762

(22) Filed: Nov. 2, 2018

(65) Prior Publication Data

US 2019/0072313 A1 Mar. 7, 2019

Related U.S. Application Data

(63) Continuation-in-part of application No. 15/693,603, filed on Sep. 1, 2017.

(51) Int. Cl.

| | |
|---|---|
| ***F25D 23/02*** | (2006.01) |
| ***A47F 3/04*** | (2006.01) |
| ***F25D 23/08*** | (2006.01) |

(52) U.S. Cl.

CPC ..... *F25D 23/02* (2013.01); *A47F 3/0434* (2013.01); *F25D 23/087* (2013.01); *F25D 2201/10* (2013.01)

(58) Field of Classification Search

CPC .... F25D 23/02; F25D 23/087; F25D 2201/10; A47F 3/0434

USPC ..... 52/204.1

See application file for complete search history.

(56) References Cited

U.S. PATENT DOCUMENTS

| | | | | |
|---|---|---|---|---|
| 3,722,928 A | | 3/1973 | Skubic | |
| 4,688,366 A | * | 8/1987 | Schmidt | E06B 3/2675 264/261 |
| 4,940,297 A | * | 7/1990 | Borgen | A47F 3/043 312/116 |
| 5,097,642 A | * | 3/1992 | Richardson | A47F 3/043 52/171.3 |
| 5,647,181 A | | 7/1997 | Hunts | |

(Continued)

OTHER PUBLICATIONS

Anthony (A Dover Company); 101B, 210X, ELM, 101X Frame Installation & Service Manual; 2011.

*Primary Examiner* — Paola Agudelo

(74) *Attorney, Agent, or Firm* — BCF LLP

(57) ABSTRACT

The present disclosure relates to an insulated door having two horizontal rails and two vertical rails. Each of the two horizontal rails is in contact at its two extremities with extremities of the two vertical rails. Each rail comprises an elongate interior side piece, an elongate exterior side piece, an elongate cover adapted to be mounted to the interior side piece, and an elongate rail insulation element linking the interior side piece to the exterior side piece. The rail insulation element prevents any direct physical contact between the interior and exterior side pieces. The door also comprises a sealed glass unit enclosed in a perimeter formed by the rails, an outside face of the sealed glass unit being in contact the exterior side pieces, an inside face of the sealed glass unit being in contact with the covers. A refrigerator door system incorporating the insulated door is also disclosed.

17 Claims, 16 Drawing Sheets

(56) References Cited

U.S. PATENT DOCUMENTS

| | | | | |
|---|---|---|---|---|
| 5,778,689 | A * | 7/1998 | Beatenbough | A47F 3/043 219/218 |
| 6,301,913 | B1 * | 10/2001 | Schulak | A47F 3/0434 62/248 |
| 7,096,640 | B1 * | 8/2006 | Chevian | E06B 3/2675 52/204.591 |
| D612,517 | S | 3/2010 | Nicholson | |
| 8,613,161 | B2 * | 12/2013 | Nicholson | A47F 3/0434 312/116 |
| 8,826,616 | B1 * | 9/2014 | Gosselin | E06B 3/9616 52/204.5 |
| 8,997,412 | B1 * | 4/2015 | Header | E06B 1/524 52/204.71 |
| 9,328,549 | B1 | 5/2016 | Alexander et al. | |
| 9,526,353 | B2 * | 12/2016 | Chubb | A47F 3/0434 |
| 2002/0078654 | A1 * | 6/2002 | Richardson | A47F 3/0434 52/656.9 |
| 2007/0266655 | A1 | 11/2007 | Howe et al. | |
| 2008/0122324 | A1 * | 5/2008 | Bienick | E05D 7/1011 312/116 |
| 2008/0190046 | A1 * | 8/2008 | Hecht | A47F 3/0434 52/173.1 |
| 2018/0038149 | A1 * | 2/2018 | Strickland | E06B 3/26305 |

* cited by examiner

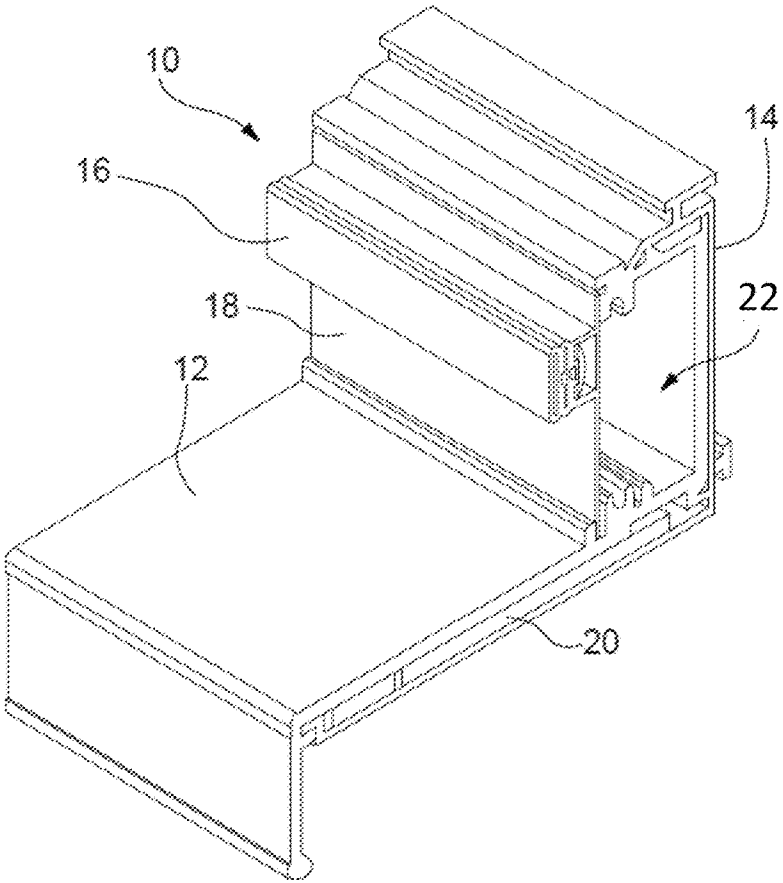
Figure 1b (Prior Art)
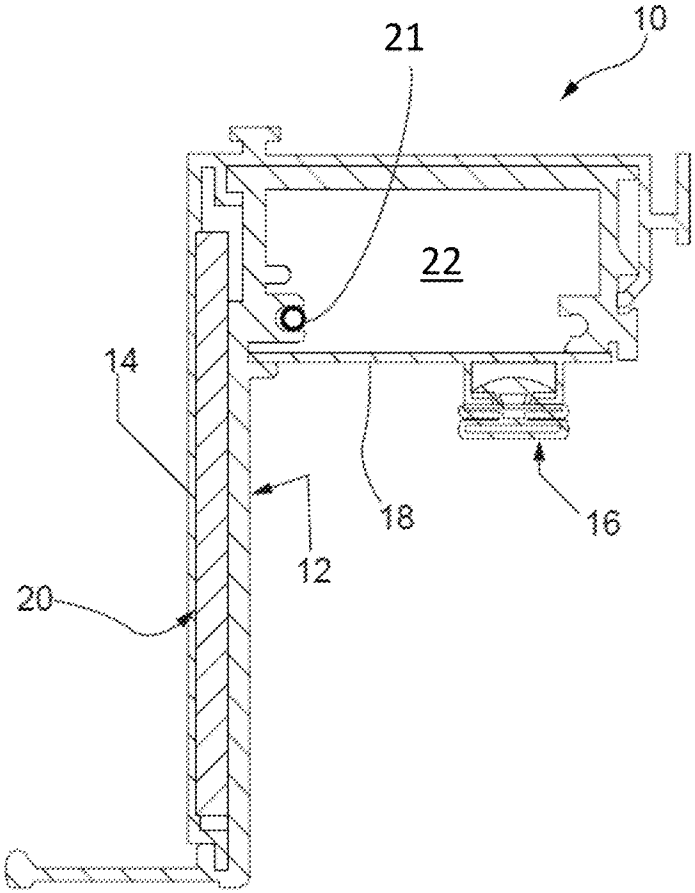
Figure 1a (Priot Art)

INSULATED DOOR AND REFRIGERATOR DOOR SYSTEM INCLUDING THE INSULATED DOOR

CROSS-REFERENCE

The present application is a continuation-in-part of U.S. patent application Ser. No. 15/693,603 filed on Sep. 1, 2017, the disclosure of which being incorporated herein in its entirety.

TECHNICAL FIELD

The present disclosure relates to the field of refrigeration equipment. More specifically, the present disclosure relates to an insulated door and to a refrigerator door system including the insulated door.

BACKGROUND

Large commercial refrigerators with glass doors are commonly found in grocery stores and convenience stores where food and drinks are stored for access to customers.

FIGS. 1*a* and 1*b* (Prior Art) are, respectively a top plan, cutaway view and a perspective view of a conventional frame section. The frame section 10 includes an external member 12, an internal member 14 and a gasket 16 mounted to the external member 12 via a gasket support 18. An edge of a refrigerator door panel (not shown) on the cold side of the refrigerator sits on the gasket 16 when the door is closed. An insulating element 20 is inserted between the external and internal members 12, 14. Thermal bridges are formed by material of the external and internal members 12, 14, for example metal, that surround the insulating element 20.

FIG. 1*c* (Prior Art) is a cutaway view of a conventional rail surrounding the glass window of a refrigerator door. The glass window is, in the general case, a sealed glass unit (SGU) 24. A rail 25 is formed as a unitary piece that extends along a horizontal or vertical side of the refrigerator door. Usually, the horizontal vertical rails 25 are identically constructed, except for their overall lengths that are cut according to the horizontal and vertical dimensions of the SGU 24. A cover (not shown) can be mounted on a side 26 of the rail 25, snapping onto a hook 27 and a recess 28 on the side 26 of the rail. The SGU 24 is held in place between the cover and the right side 29 of the rail 25.

Refrigerator doors and frames must be sturdy in order to withstand frequent and sometimes careless opening and closing by customers. For that reason, refrigerator doors frames, horizontal door rails and vertical door rails (sometimes called 'stiles') are commonly made of steel or aluminum. Because these materials are good thermal conductors, condensation on refrigerator glass door panels is a significant problem. Use of other materials that are not good thermal conductors, for example polyvinyl chloride (PVC), is generally not practical because they these materials will break even when subject to modest abuse.

Shop owners desire to keep their glass doors free of any fogging in order to allow customers to clearly see the products that are available on refrigerator shelves. A common solution to the condensation problem is to install cable heating elements 21 within an open space 22 defined in refrigerator door frames and cable heating elements 23 onto the side 26 of the rail 25, the cable heating elements 23 being protected by the cover mounted on the side 26 of the rail 25. While this solution is effective in preventing condensation, it is highly inefficient in terms of energy consumption. Given the opposite requirements of keeping the inside of the refrigerator cold while keeping the door frames warm, electrical energy waste is considerable.

Therefore, there is a need for improvements in the construction of refrigerator doors and door frames that compensate for problems related to condensation and to waste of energy.

SUMMARY

According to the present disclosure, there is provided an insulated door comprising two horizontal rails, two vertical rails, and a sealed glass unit (SGU). Each of the two horizontal rails is in contact at its two extremities with extremities of the two vertical rails. Each rail comprises an elongate interior side piece, an elongate exterior side piece, an elongate cover adapted to be mounted to the interior side piece, and an elongate rail insulation element linking the interior side piece to the exterior side piece. The rail insulation element prevents any direct physical contact between the interior and exterior side pieces. The SGU is enclosed in a perimeter formed by the two horizontal rails and the two vertical rails. An outside face of the SGU is in contact the exterior side pieces and an inside face of the SGU is in contact with the covers.

According to the present disclosure, there is also provided a refrigerator door system comprising a door frame and an insulated door. The door frame comprises four frame sections assembled to form a rectangular opening. The insulated door comprises two horizontal rails, two vertical rails, and a sealed glass unit (SGU). Each of the two horizontal rails is in contact at its two extremities with extremities of the two vertical rails. Each rail comprises an elongate interior side piece, an elongate exterior side piece, an elongate cover adapted to be mounted to the interior side piece, and an elongate rail insulation element linking the interior side piece to the exterior side piece. The rail insulation element prevents any direct physical contact between the interior and exterior side pieces. The SGU is enclosed in a perimeter formed by the two horizontal rails and the two vertical rails. An outside face of the SGU is in contact the exterior side pieces and an inside face of the SGU is in contact with the covers The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which:

FIGS. 1*a* and 1*b* (Prior Art) are, respectively a top plan, cutaway view and a perspective view of a conventional frame section;

Like numerals represent like features on the various drawings. The Figures may not be to scale.

DETAILED DESCRIPTION

Figure 1C:
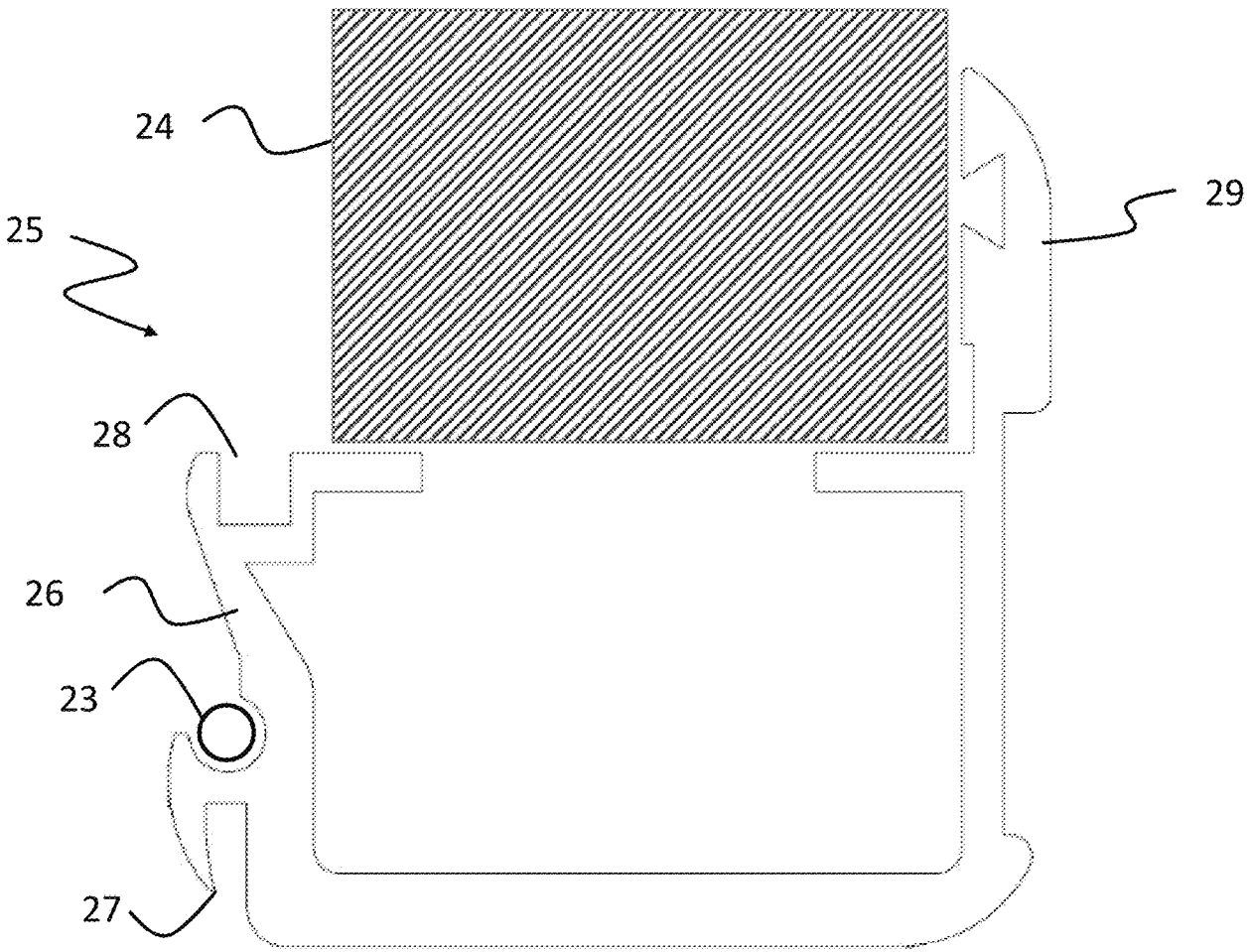
Figure 1c (Prior Art)
FIG. 1*c* (Prior Art) is a cutaway view of a conventional rail surrounding the glass window of a refrigerator door.

Various aspects of the present disclosure generally address one or more of the problems of condensation and energy waste of commercial refrigerator doors.

In an aspect of the present technology, insulated frame sections for use in fabricating a refrigerator door frame are constructed of an elongate exterior frame member adapted for mounting to a solid frame of the refrigerator, an elongate interior frame member adapted for receiving a gasket on which a refrigerator door will abut when closed, and an elongate frame insulation element. The interior frame member and the exterior frame member are both connected to the frame insulation element while not touching each other. In an embodiment, the interior and exterior frame member are made of aluminum, steel or other metal having sufficient rigidity to withstand frequent opening and closing of the refrigerator door. Such metal also has a very high thermal conductivity. The frame insulation element has very low thermal conductivity. It is constructed of a solid plastic material, for example polyvinyl chloride (PVC) or polypropylene, and has a compact cross-section to enhance its rigidity.

In another aspect of the present technology, a refrigerator door, that may for example be mounted on the above-described refrigerator door frame, comprises insulated rails forming a perimeter surrounding a glass window. Each rail comprises an interior side piece and an exterior side piece that are both connected to a rail insulation element while not touching each other. In an embodiment, the interior and exterior side pieces of the rail are made of aluminum, steel or other metal having sufficient rigidity to withstand frequent opening and closing of the refrigerator door. Such metal also has a very high thermal conductivity. The rail insulation element has very low thermal conductivity. It is constructed of a solid plastic material, for example polyvinyl chloride (PVC) or polypropylene, and has a compact cross-section to enhance its rigidity.

In the context of the present disclosure, the exterior frame members of the refrigerator door frame and the exterior side pieces of the rails are at least in part located on a "warm" side of the refrigerator, being exposed to external heat sources when the door is closed. The interior frame members of the refrigerator door frame and the interior side piece of the rails are generally or entirely located on a "cold" side of the refrigerator, being essentially insulated from outside heat sources when the door is closed.

In the literature, the expressions 'door rail' or simply 'rail' may be used to designate the elements forming horizontal pieces of the perimeter of a refrigerator door while the expressions 'door stile' or simply 'stile' may be used to designate the elements forming vertical pieces of the perimeter of a door. However, the term 'rail' is frequently used in the door industry to designate all parts forming the perimeter of a door, whether these parts are horizontal or vertical. The term 'rail' may be replaced with the term 'stile' in any part of the present disclosure, particularly in reference to vertical rails. Use of the term 'rail' where the term 'stile' could also be used is not meant to limit the generality of the present disclosure.

Figure 2:
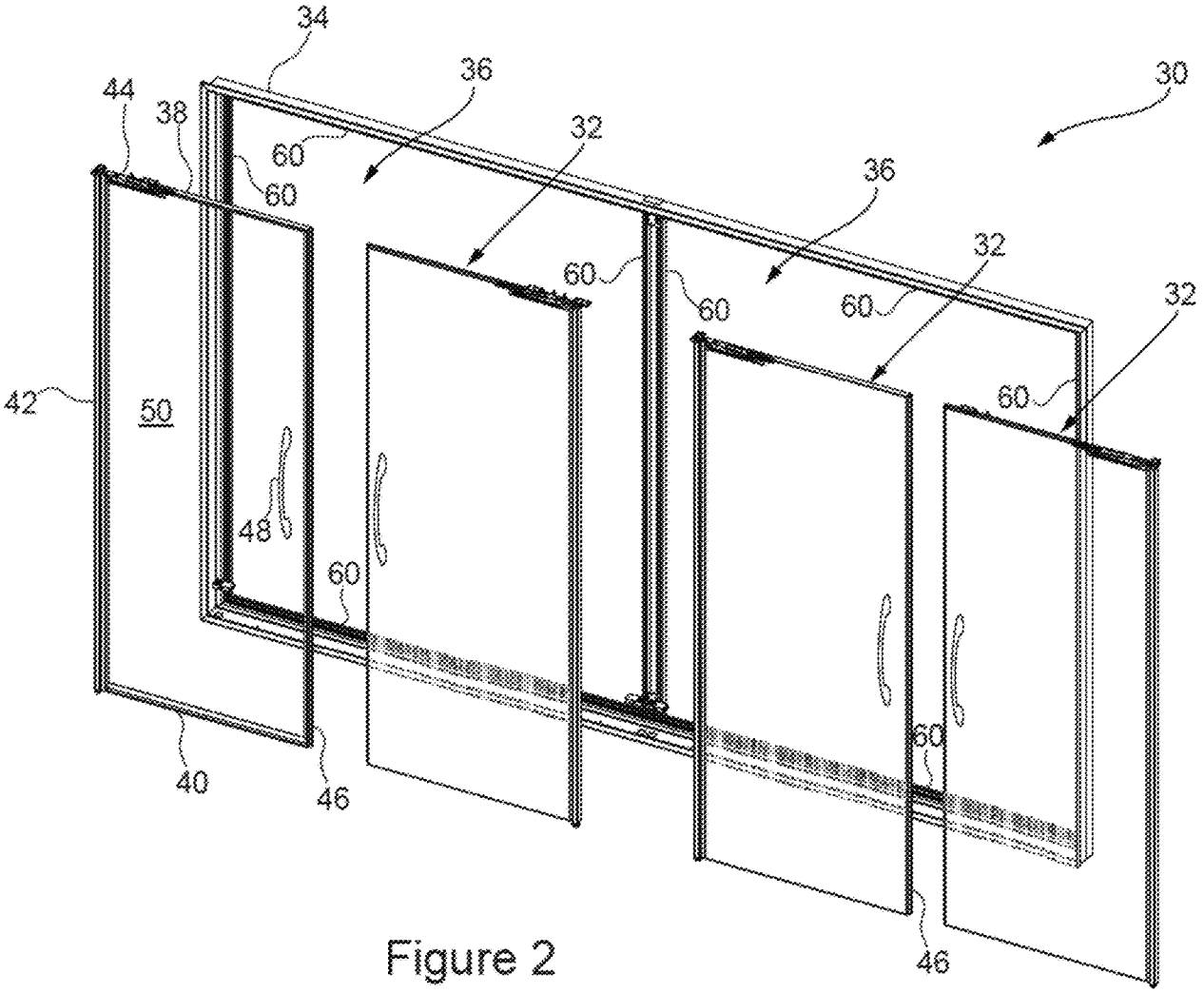
FIG. 2 is a perspective, exploded view of a refrigerator door system incorporating insulated doors and a door frame constructed of insulated frame sections.

Referring now to the drawings, FIG. 2 is a perspective, exploded view of a refrigerator door system incorporating doors and a door frame constructed of insulated frame sections. A refrigerator door system 30 as shown includes four (4) glass doors 32 mounted in a door frame 34 having two (2) openings 36, each of the openings 36 receiving two (2) of the glass doors 32. Each door 32 includes a first horizontal rail 38 at its top, a second horizontal rail 40 at its bottom, a first vertical rail 42 (or stile 42) on which are mounted a pair of hinges 44 (only a top hinge 44 is shown, a bottom hinge not being shown), and a second vertical rail 46 (or stile 46). A door handle 48 is mounted on a glass window 50, for example a sealed glass unit (SGU), near the second vertical rail 46. The door frame 34 is constructed of insulated frame sections that will be described hereinbelow.

Figure 3:
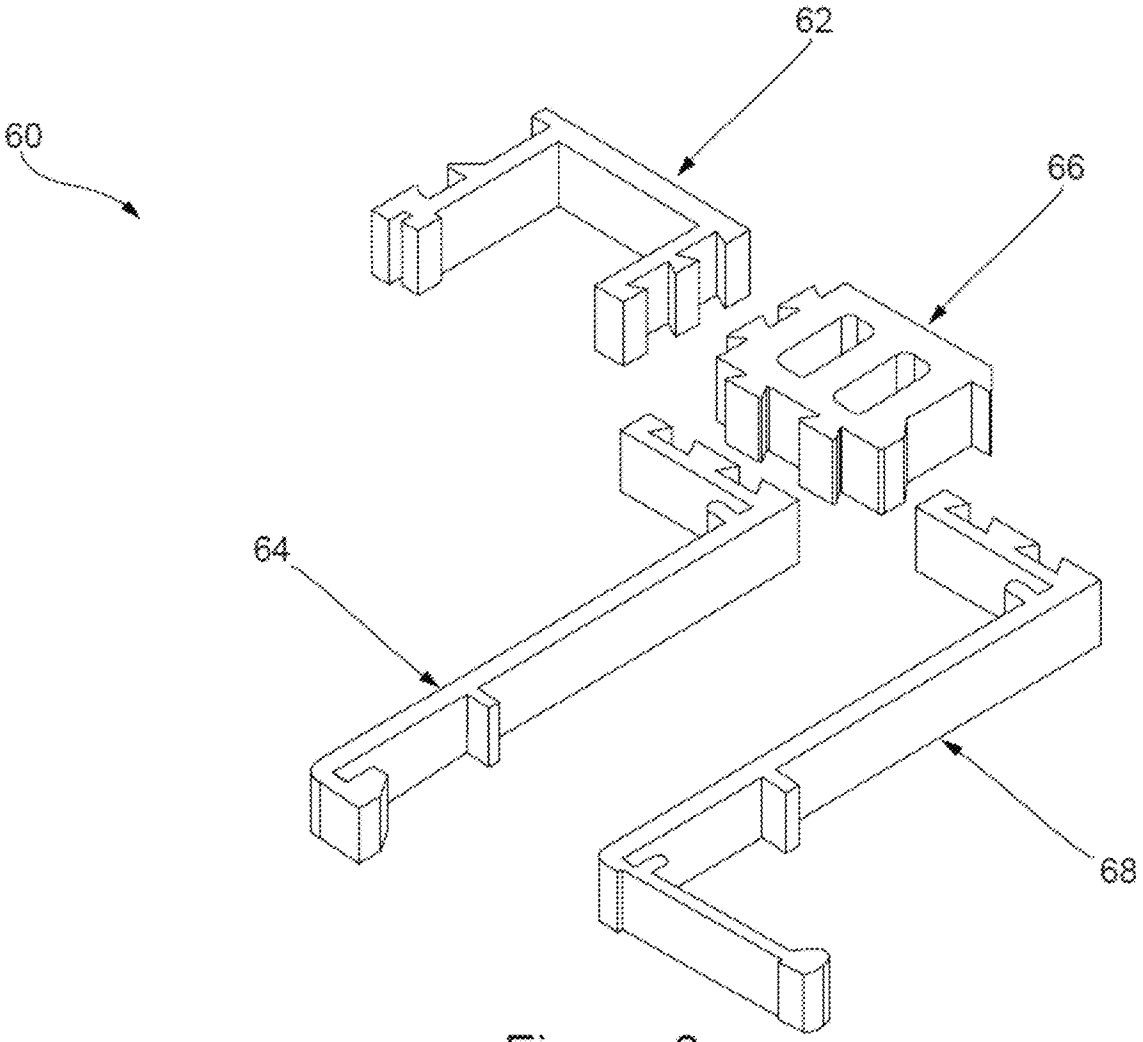
FIG. 3 is a perspective, exploded and cutaway view showing disassembled components of the insulated frame section.
Figure 5:
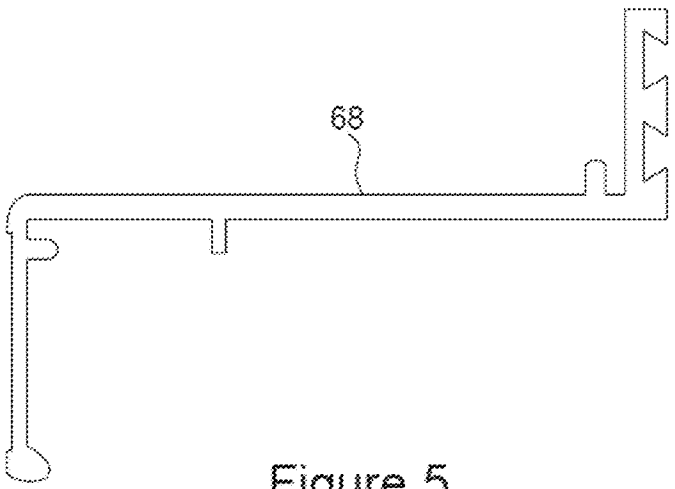
FIG. 5 is a top plan view of a top or bottom exterior frame end of the insulated frame section of FIG. 2.
Figure 4:
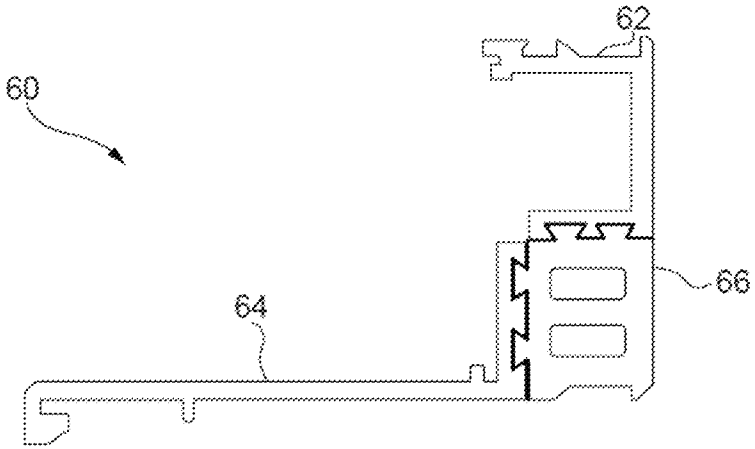
FIG. 4 is a top plan, cutaway view of the insulated frame section of FIG. 2.
Figure 6:
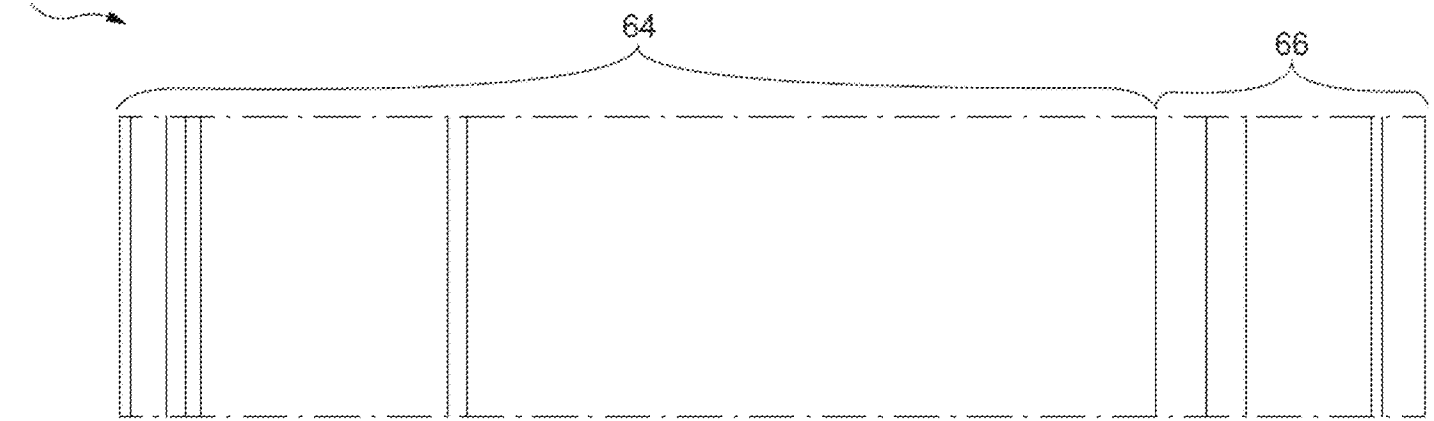
FIG. 6 is an elevation, cutaway view of the insulated frame section of FIG. 2.
Figure 7:
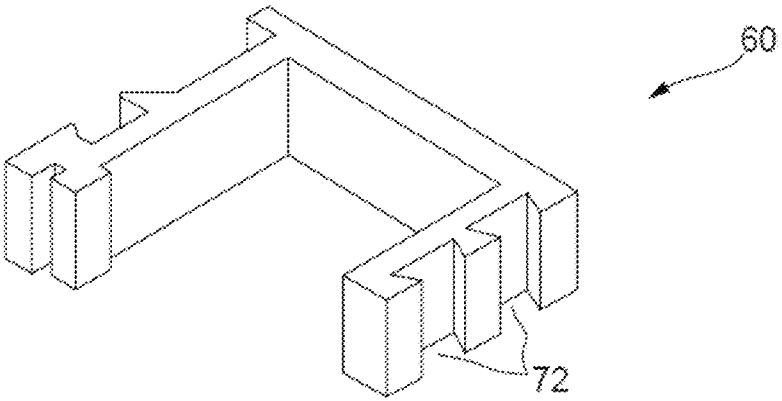
FIG. 7 is a perspective and cutaway view of an interior frame member of the insulated frame section of FIG. 2.
Figure 8:
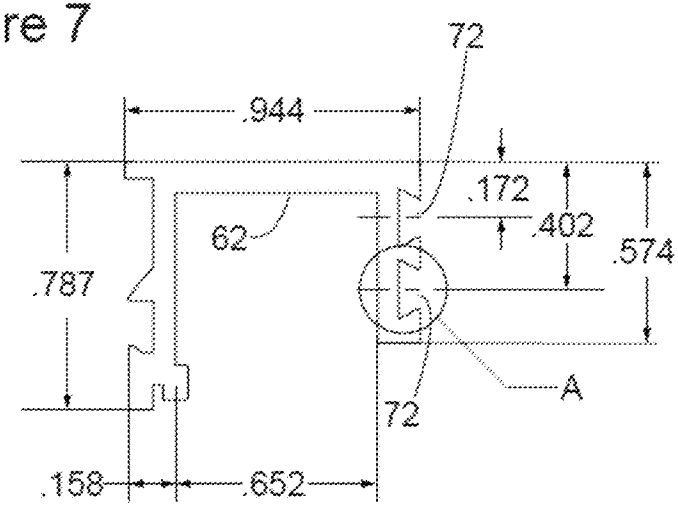
FIG. 8 is a top plan view of the interior frame member of FIG. 7.
Figure 9:
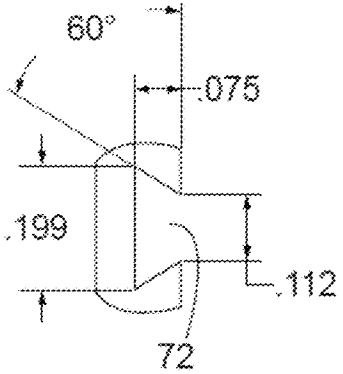
FIG. 9 is a detailed view of FIG. 8 at area A.
Figure 10:
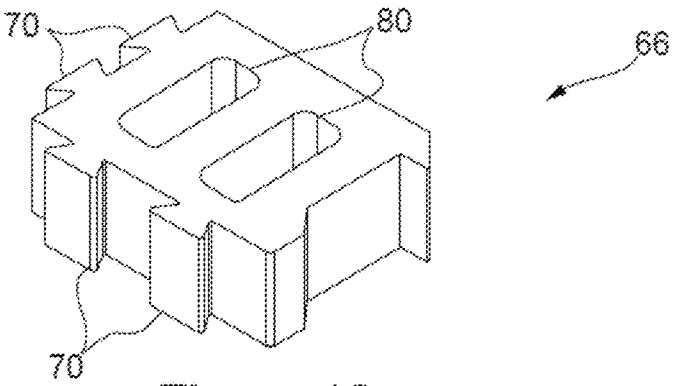
FIG. 10 is a perspective and cutaway view of a frame insulation element of the insulated frame section of FIG. 2.
Figure 11:
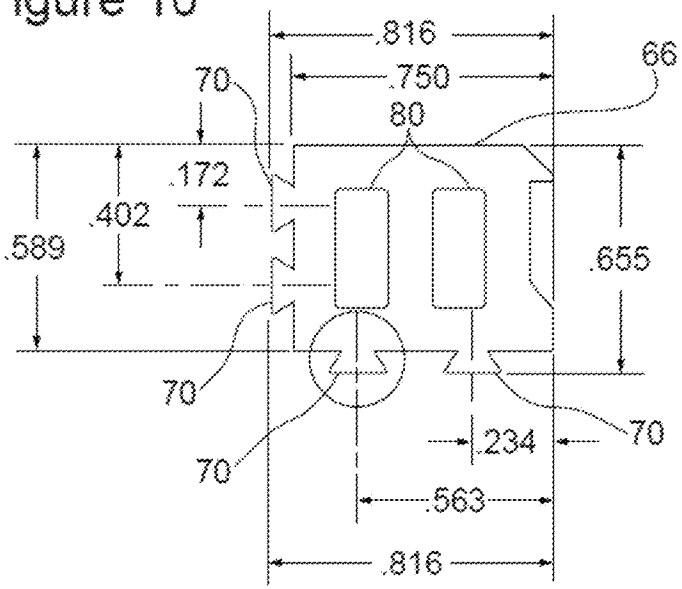
FIG. 11 is a top plan, cutaway view of the frame insulation element of FIG. 10.
Figure 12:
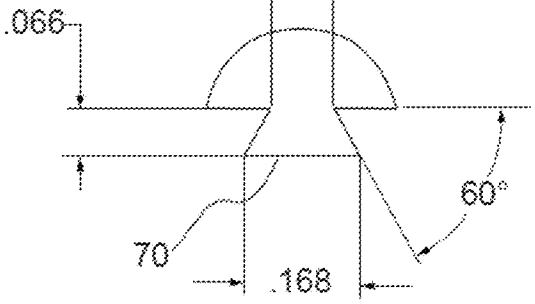
FIG. 12 is a detailed view of FIG. 11 at area B.
Figure 14:
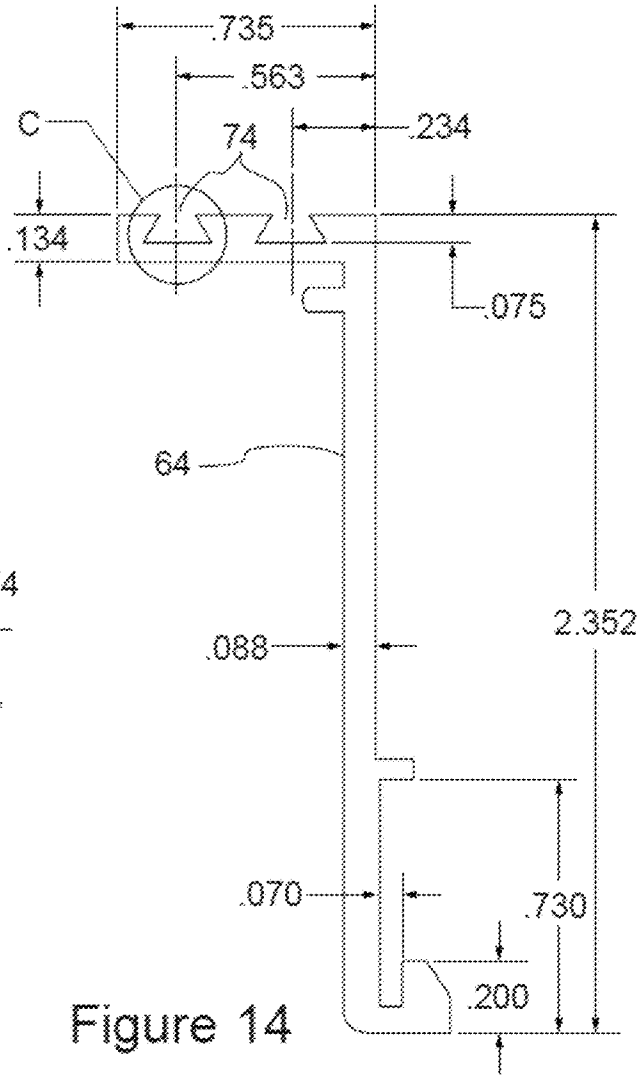
FIG. 14 is a top plan view of the exterior frame member of FIG. 13.
Figure 15:
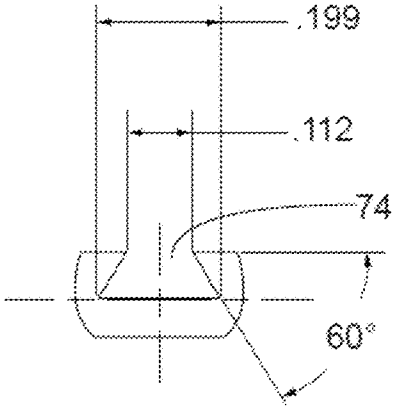
FIG. 15 is a detailed view of FIG. 14 at area C.
Figure 13:
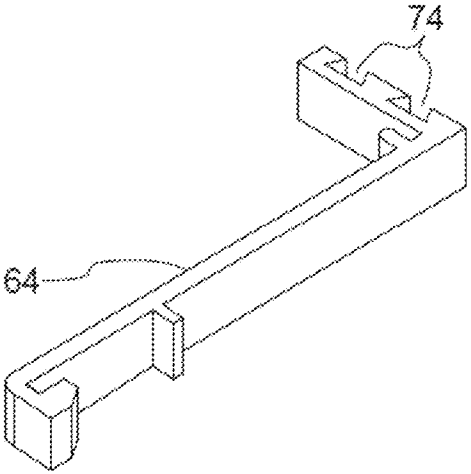
FIG. 13 is a perspective and cutaway view of the exterior frame member of the insulated frame section of FIG. 2.
Figure 17:
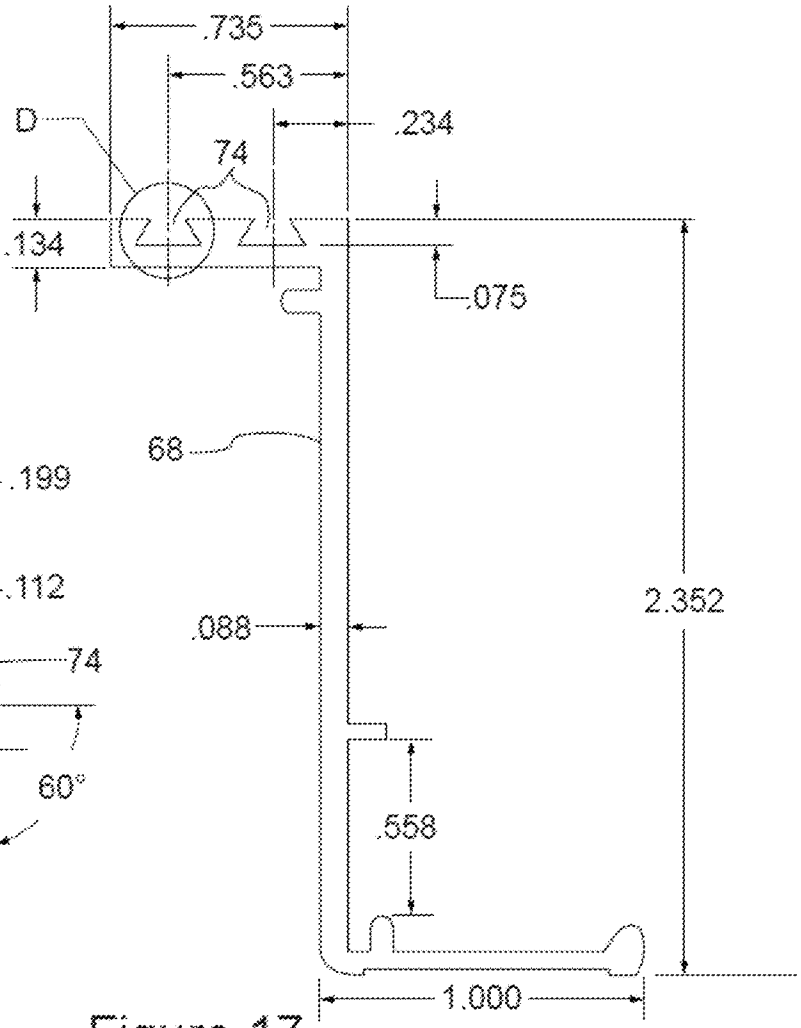
FIG. 17 is a top plan view of the top or bottom exterior frame end of FIG. 16.
Figure 18:
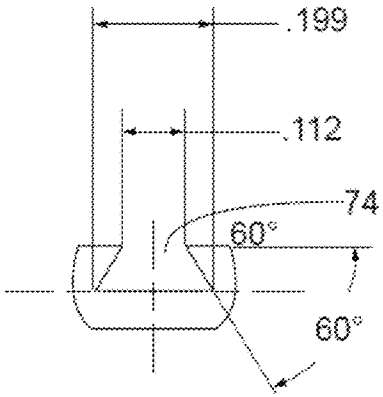
FIG. 18 is a detailed view of FIG. 17 at area D.
Figure 16:
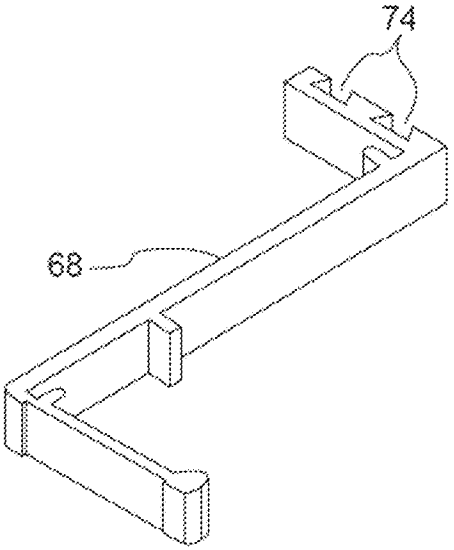
FIG. 16 is a perspective view of the top or bottom exterior frame end of the insulated frame section of FIG. 2.

FIG. 3 is a perspective, exploded and cutaway view showing disassembled components of the insulated frame section. FIG. 4 is a top plan, cutaway view of the insulated frame section of FIG. 2. FIG. 5 is a top plan view of a top or bottom exterior frame end of the insulated frame section of FIG. 2. FIG. 6 is an elevation, cutaway view of the insulated frame section of FIG. 2. FIG. 7 is a perspective and cutaway view of an interior frame member of the insulated frame section of FIG. 2. FIG. 8 is a top plan view of the interior frame member of FIG. 7. FIG. 9 is a detailed view of FIG. 8 at area A. FIG. 10 is a perspective and cutaway view of a frame insulation element of the insulated frame section of FIG. 2. FIG. 11 is a top plan, cutaway view of the frame insulation element of FIG. 10. FIG. 12 is a detailed view of FIG. 11 at area B. FIG. 13 is a perspective and cutaway view of the exterior frame member of the insulated frame section of FIG. 2. FIG. 14 is a top plan view of the exterior frame member of FIG. 13. FIG. 15 is a detailed view of FIG. 14 at area C. FIG. 16 is a perspective view of the top or bottom exterior frame end of the insulated frame section of FIG. 2. FIG. 17 is a top plan view of the top or bottom exterior frame end of FIG. 16. FIG. 18 is a detailed view of FIG. 17 at area D. Referring at once to FIGS. 3-18, in an embodiment as illustrated, an insulated frame section 60 comprises an elongate interior frame member 62, an elongate exterior frame member 64 and an elongate frame insulation element 66. The frame insulation element 66 forms a continuous union connecting the interior frame member 62 to the exterior frame member 64. The frame insulation element 66 prevents any direct physical contact between the interior and exterior frame members 62, 64. A frame end 68 may be placed at each extremity of the insulated frame section 60. In an alternate embodiment, the exterior frame member 64 can adopt, over its entire length, the same cross-section as that of the frame end 68, as shown on FIG. 5. In the context of the present disclosure, the term "elongate" when used to qualify a component of the insulated frame section is synonymous with "slender"; any element qualified by this term has a length that is significantly broader than its cross-section. Any one or all of the interior and exterior frame members and of the frame insulation element 66 may be fabricated using an extrusion process.

In the embodiment as shown, the frame insulation element 66 is connected to the interior frame member 62 and to the exterior frame member 64 by dovetail joints. In more details, the frame insulation element 66 has a number of pins 70 that are sized and configured for insertion in tails 72 of the interior frame member 62 and in tails 74 of the exterior frame member 64 and of the frame end 68. This manner of connecting the interior and exterior frame members 62, 64 to the frame insulation element 66 is illustrative and non-limiting. In particular, a number of dovetail joints may be greater or smaller than as shown on the various drawings.

Dimensions shown on FIGS. 8, 9, 11, 12, 14, 15, 17 and 18 are in inches, except for angles which are in degrees. The values as shown are for a particular implementation and are provided herein as non-limitative examples.

The frame insulation element 66 as shown in the example of FIGS. 10 and 11 has a generally rectangular cross-section and is traversed by two (2) elongated openings 80 that extend along a length of the frame insulation element 66. The openings 80 may be filled with air. This particular non-limitative construction of the frame insulation element 66 is easily obtained by an extrusion process and at once confers rigidity and thermal characteristics to the frame insulation element 66.

In an embodiment, each door 32 is an insulated door 32 comprising an SGU surrounded by four (4) insulated rail sections. Without limitation, these doors are particularly suited for commercial freezer applications.

Figure 19:
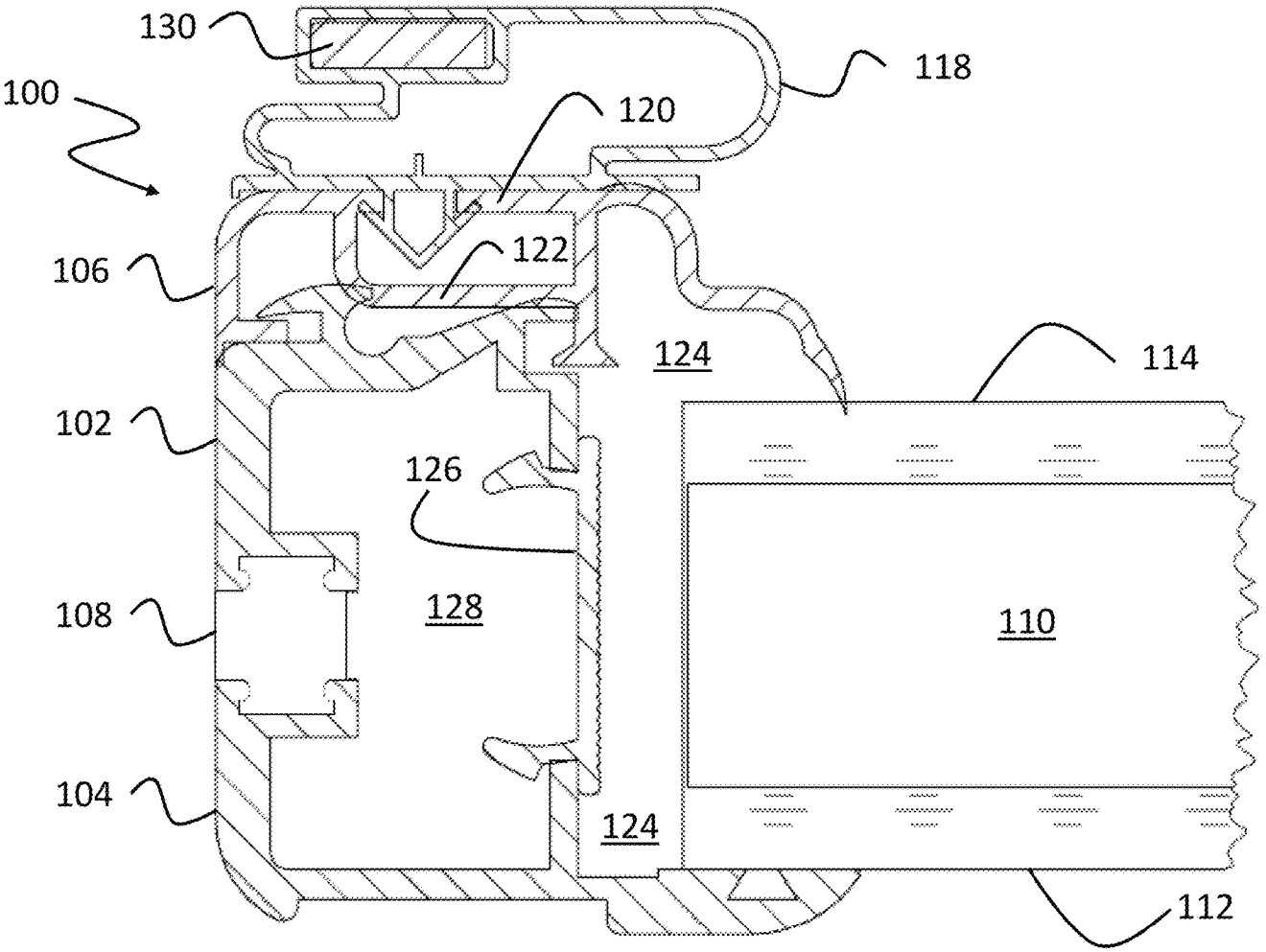
FIG. 19 is a cutaway view of a rail according to an embodiment.
Figure 20:
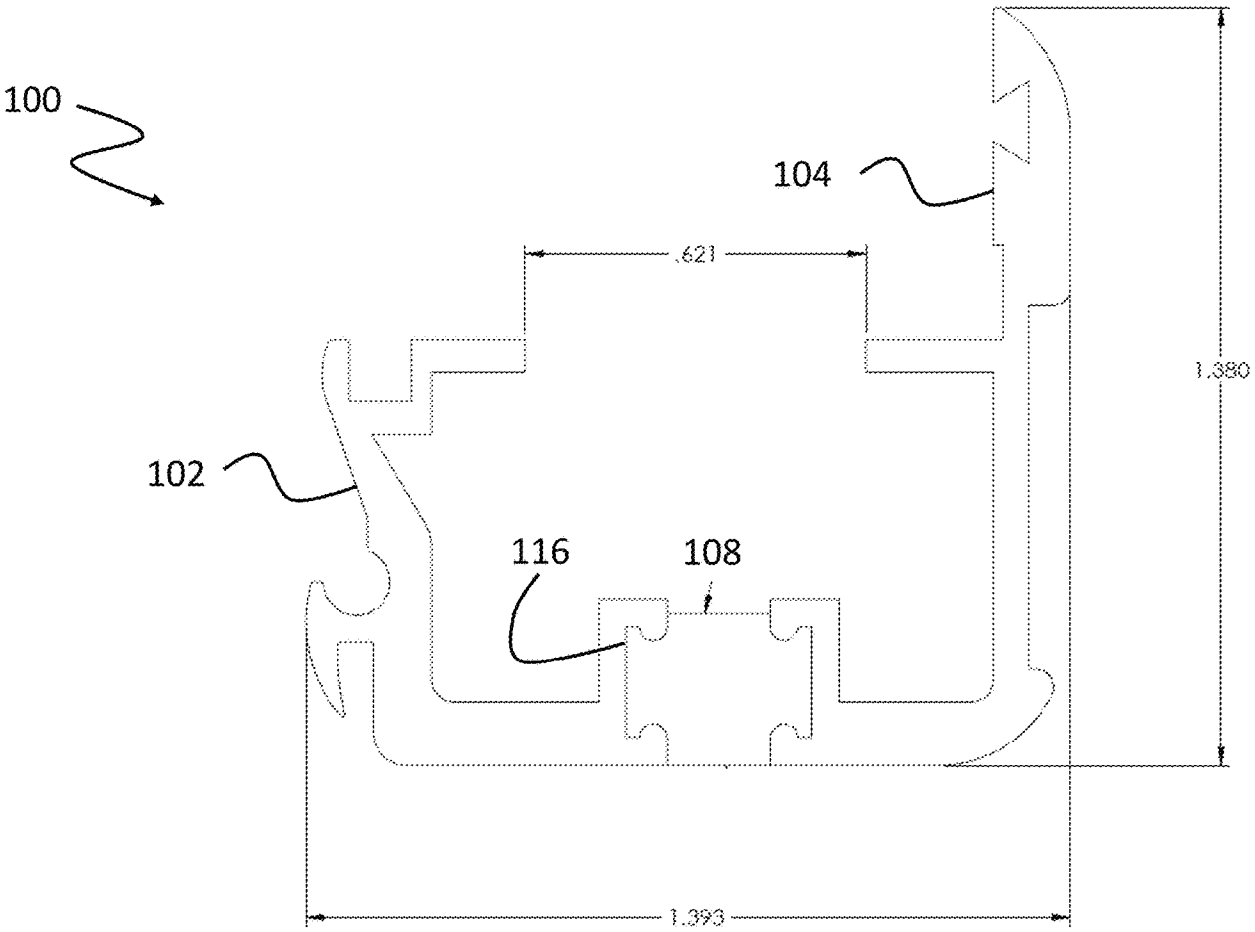
FIG. 20 is a cutaway view showing details of the rail of FIG. 19.
Figure 21:
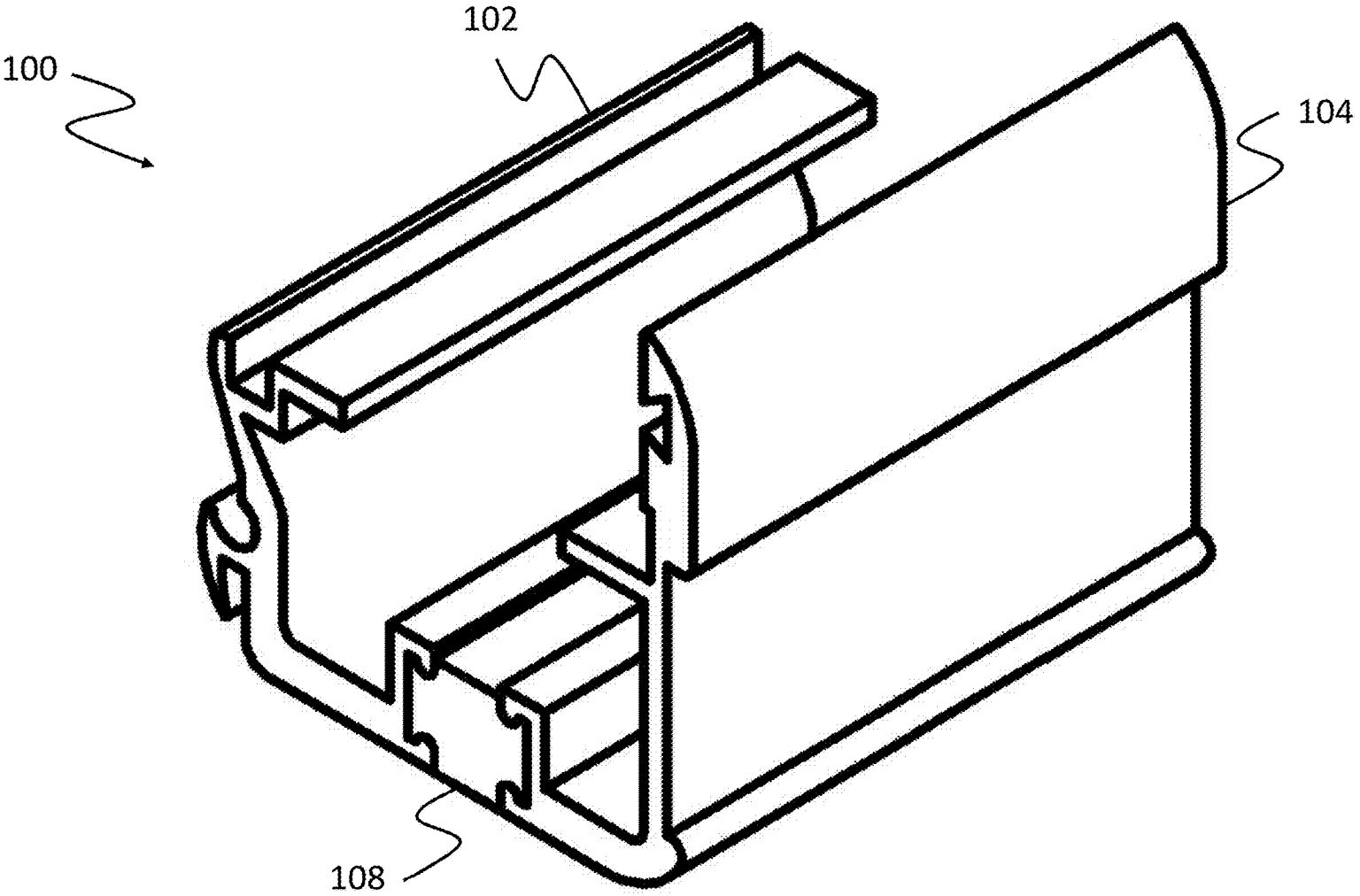
FIG. 21 is a perspective view of the rail of FIG. 19.
Figure 22:
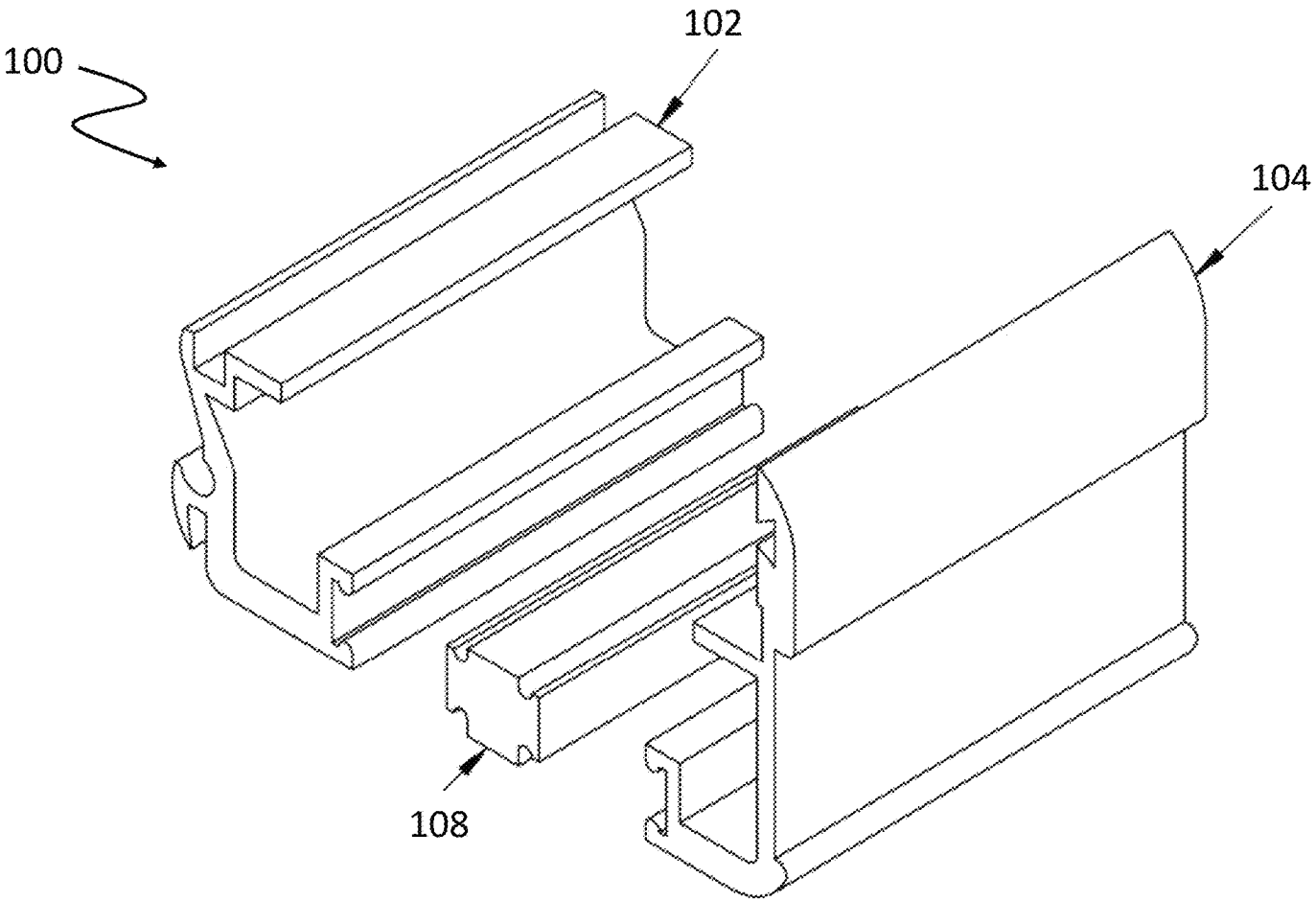
FIG. 22 is an exploded perspective view of the rail of FIG. 19.

FIG. 19 is a cutaway view of a rail according to an embodiment. FIG. 20 is a cutaway view showing details of the rail of FIG. 19. FIG. 21 is a perspective view of the rail of FIG. 19. FIG. 22 is an exploded perspective view of the rail of FIG. 19. Referring at once to FIGS. 19-22, a particular example of the rails 38, 40, 42 and 46 is denoted as a rail 100 for simplicity. Each rail 100 is elongate and slender, and its parts are also generally elongate and slender. Each rail 100 comprises an interior side piece 102, an exterior side piece 104, a cover 106 adapted to be mounted to the interior side piece 104, and a rail insulation element 108. The rail insulation element 108 forms a solid link between the interior side piece 102 and the exterior side piece 104. The rail insulation element 108 prevents any direct physical contact between the interior and exterior side pieces 102 and 104. A sealed glass unit (SGU) 110 is enclosed in a perimeter formed by two horizontal rails 100 (e.g. the rails 38 and 40) and two vertical rails 100 (e.g. the rails 42 and 46). An outside (warm) face 112 of the SGU 110 is held in contact the exterior side pieces 104 of each rail 100 and an inside (cool or cold) face 114 of the SGU 11 is held in contact with the covers 106.

As illustrated, in a non-limiting embodiment, wherein the rail insulation element 108 is connected to the interior side piece 102 and to the exterior side piece 104 by dovetail joints 116.

Each rail 100 further may comprise an elongate gasket 118 mounted on the cover 106, on a side 120 of the cover 106 opposite side from another side 122 of the cover 106 mounted to the interior side piece 102. An elongate magnet 130 may be integrated within the gasket 118.

The door 32 is assembled by attaching four (4) appropriately dimensioned rails 100 (e.g. rails 38, 40, 42 and 46), placing the SGU 110 in a perimeter formed by the rails 100, and filling with an adhesive, at least in part, spaces 124 that surround edges of the SGU 110, in areas of contact of the SGU 110 with the rails 100. An elongate cap 126 may be inserted between the interior and exterior side pieces 102 and 104 of each of the rails 100 so to form, in each of the rails, a channel 128 delimited by the interior side piece 102, the rail insulation element 108, the exterior side piece 104 and the cap 126. The cap 126 prevents the adhesive from entering into the channel 128.

The cover 106 may be made of PVC, of plastic, or any material that is sufficiently resilient to hold the gasket 118 and to withstand opening and closing of the door 32 in low temperature conditions. The gasket 118 may for example be made of rubber. The cap 126 may be made of the same material as used for the rail insulation element 108 or of a different material also having a low thermal conductivity, for example a plastic.

Any one or all of the parts forming the rail 100 may be fabricated using an extrusion process.

Figure 23:
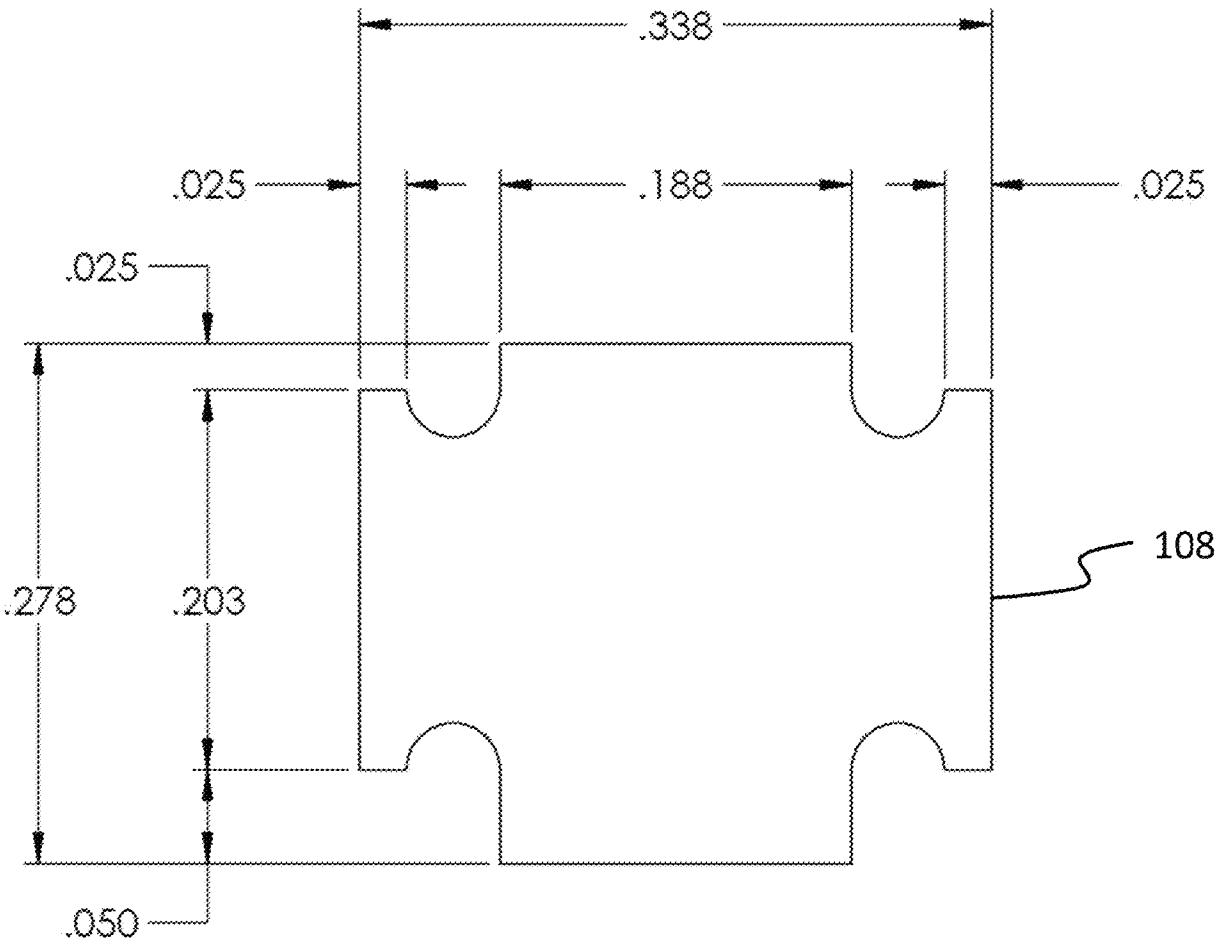
FIG. 23 is a detailed cross-sectional view of the rail insulation element of the rail of FIG. 19.

FIG. 23 is a detailed cross-sectional view of the rail insulation element of the rail of FIG. 19. This Figure highlights the compact cross-section of the rail insulation element 108 designed to enhance its rigidity. Dimensions shown on FIG. 23 are in inches. The values as shown are for a particular implementation of the rail and are provided herein as non-limitative examples.

Figure 24:
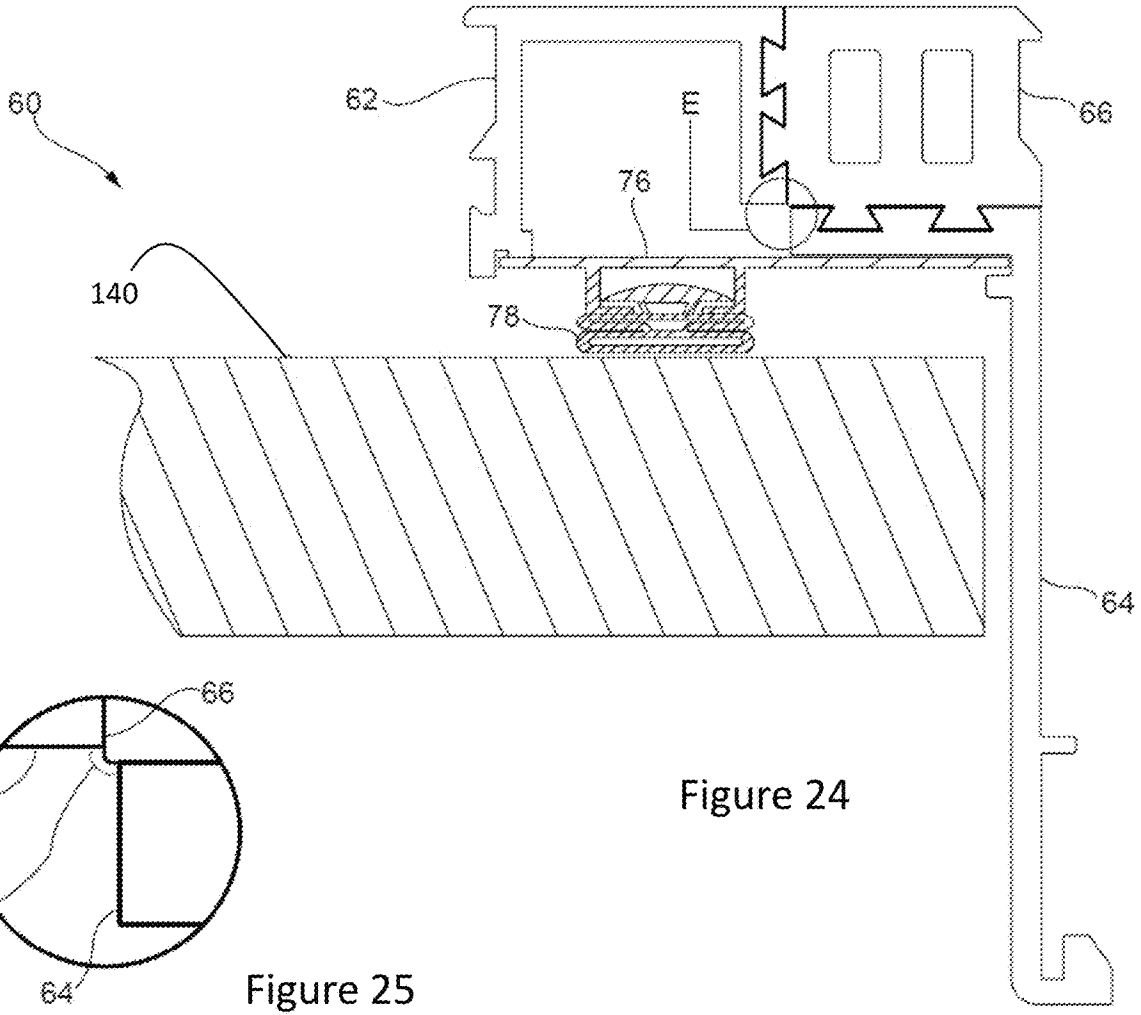
FIG. 24 is another top plan, cutaway view of the insulated frame section of FIG. 2 further showing a gasket, a gasket retainer and the end of a generic door having with its end abutting on the gasket.

FIG. 24 is another top plan, cutaway view of the insulated frame section of FIG. 2 further showing a gasket, a gasket retainer and the end of a generic door 140 having its end abutting on the gasket. As shown on FIG. 24, an elongate gasket retainer 76 is mounted between the interior and exterior frame members 62, 64. The gasket retainer 76 may be made of the same material as used for the frame insulation element 66 or of a different material also having a low thermal conductivity, for example a plastic. An elongate gasket 78, for example made of rubber, is mounted to the gasket retainer 76. One of the horizontal rails 38, 40 or one of the vertical rails 42, 46 of the door 32 may rest on the gasket 78, depending on the location of the insulating frame section 60 on the door frame 34 of FIG. 2.

Figure 25:
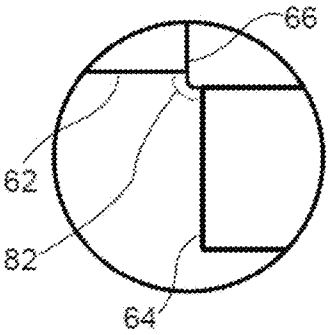
FIG. 25 is a detailed view of FIG. 24 at area E.

FIG. 25 is a detailed view of FIG. 24 at area E. As may be observed considering FIG. 25, there is no direct physical contact between the interior frame member 62 and the exterior frame member 64, these frame members 62, 64 being connected indirectly via the frame insulation element 66. A gap 82 is present between the interior and exterior frame members 62, 64. The interior frame member 62 and the exterior frame member 64 are also indirectly connected by the gasket retainer 76 which also has a low thermal conductivity. As such, no thermal bridge reduces the effectiveness of the insulation provided by the frame insulation element 66.

Figure 26:
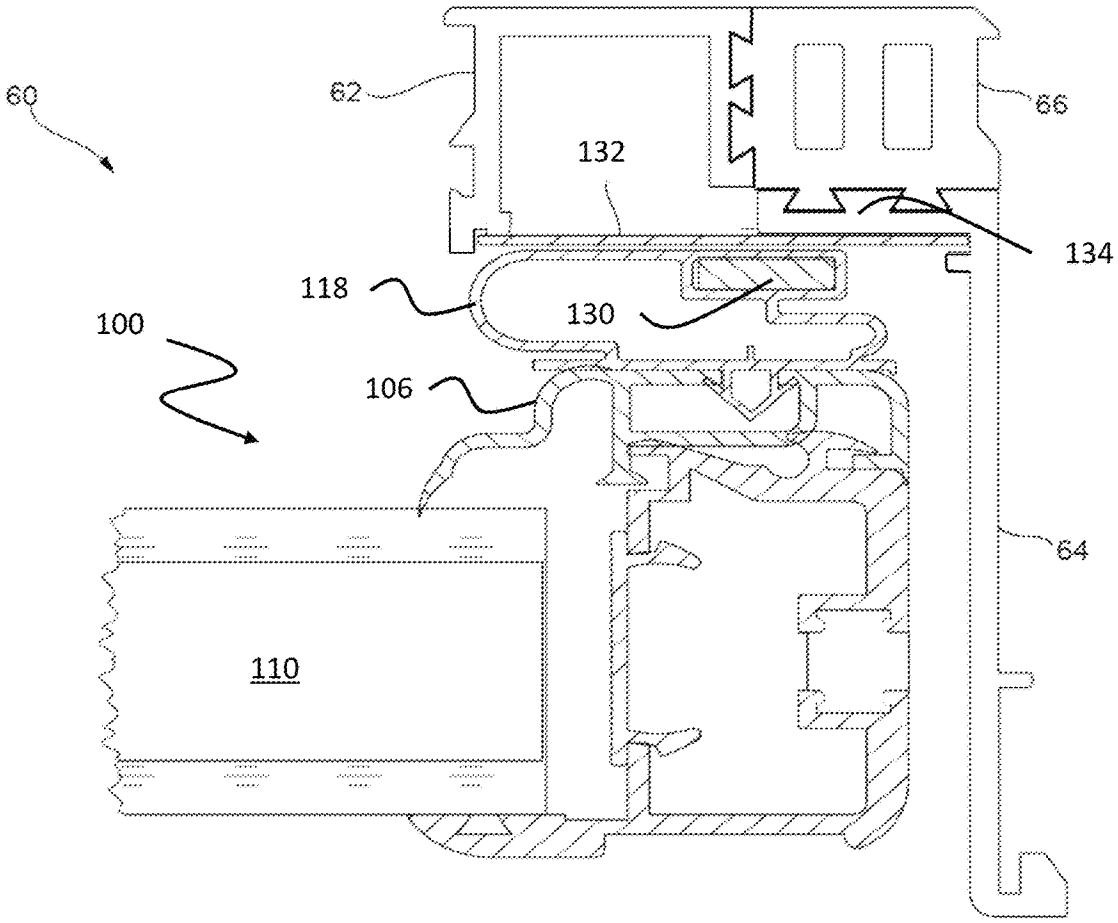
FIG. 26 is a further top plan, cutaway view of a variant of the insulated frame section of FIG. 2 further showing the rail of FIG. 19.

FIG. 26 is a further top plan, cutaway view of a variant of the insulated frame section of FIG. 2 further showing the rail of FIG. 19. The gasket retainer 76 shown on FIG. 24 is replaced with an elongate plate 132 that, like the gasket retainer 76, is also made of a low thermal conductivity material, for example plastic. The gasket 78 of FIG. 24 is not present given that the rail 100 includes the gasket 118 that is positioned to abut on the plate 132. The magnet 130 integrated in the gasket 118 is in close proximity to a rear portion 134 of the exterior frame member 64 so that the door 32 is maintained in a closed position with the seal 118 abutting on the plate 132.

Returning now to FIG. 2, the refrigerator door system 30 includes the door frame 34 which is constructed of a number of insulated frame sections 60 and one of more doors 32. For a single door 32, the door frame 34 would comprise four (4) insulated frame sections 60, two (2) of which would be mounted horizontally and two (2) of which would be mounted vertically. Each door 32 may, without limitation, be constructing with rails as illustrated on FIGS. 19-22. There is no a priori limit to the size of the door frame 34 or to the number of doors 32 that may be mounted in the refrigerator door system 30. In the example of FIG. 2, each pair of doors 32 is mounted so that door handles 48 of the pair are in close proximity when the doors 32 are closed, the hinges 44 for the pair of doors 32 being mounted in opposite corners of the door frame 34. In a variant, all doors 32 could open in the same direction. While no vertical insulated frame sections 60 are shown between each doors 32 of a pair, it is contemplated that additional insulated frame sections 60 may be installed in the door frame 34 so that the vertical rails 46 may rest on a gasket 78 when the doors 32 are closed.

Although not shown on the various drawings, cable heating elements may be installed within at least some of the frame sections 60 or in in at least some of the rails 38, 40, 42 and 46. Despite the use of the frame and rail insulation elements of the present technology, fogging may still appear on doors 32 installed in particularly difficult environments. Regardless, the present technology will greatly reduce, if not entirely eliminate, the energy consumed by these cable heating elements when compared to conventional refrigerator door systems.

At least one and generally both of the interior and exterior frame members 62, 64, as well as the frame end 68 and at least one of the interior and exterior side pieces 102 and 104 of the rails 38, 40, 42 and 46 are made of a material having a first level of thermal conductivity. The frame insulation element 66 and the rail insulation element 108 are made of a material having a second level of thermal conductivity, the first level of thermal conductivity being greater than the second level of thermal conductivity. Non-limiting examples of materials that may be used to construct the insulated frame section are listed in Table I, in which thermal conductivity is expressed in terms of watts per meter-kelvin (W/(m–K)).

It is noted that the rail insulation element 108 and the frame insulation element 66 may, but are not necessarily be made of the same low-thermal conductivity material. Likewise, the frame members 62, 64 and the side pieces 102 and 104 of the rails 38, 40, 42 and 46 may, but are not necessarily be made of the same high-thermal conductivity material.

TABLE I

| Material | Use | Thermal Conductivity |
|---|---|---|
| Aluminum | Interior and exterior frame members; Interior and exterior side pieces of the rail | 205 |
| Magnesium | Interior and exterior frame members; Interior and exterior side pieces of the rail | 156 |
| Magnesium alloy | Interior and exterior frame members; Interior and exterior side pieces of the rail | 70-145 |
| PVC | Frame insulation element; Gasket retainer; Plate; Rail insulation element; Cap | 0.19 |
| Polypropylene | Frame insulation element; Gasket retainer; Plate; Rail insulation element; Cap | 0.1-0.22 |
| Nylon 6 | Frame insulation element; Gasket retainer; Plate; Rail insulation element; Cap | 0.25 |

In an embodiment in which the interior and exterior frame members are made of aluminum, the frame insulation element being made of polypropylene, a ratio of the thermal conductivity of the materials may be as high as 2050:1. In another embodiment in which the interior and exterior frame members are made of a magnesium alloy, the frame insulation element being made of nylon, a ratio of the thermal conductivity of the materials may be as low as 280:1. In other embodiments using aluminum with polypropylene or PVC, the ratio of the thermal conductivity of the materials may be in a range of 930:1 to 2050:1. The same ranges also apply to embodiments of the rails using the same material combinations for the interior and exterior side pieces of the rail and for the rail insulation element.

Those of ordinary skill in the art will realize that the description of the insulated frame sections and refrigerator door systems are illustrative only and are not intended to be in any way limiting. Other embodiments will readily suggest themselves to such persons with ordinary skill in the art having the benefit of the present disclosure. Furthermore, the disclosed insulated frame sections and refrigerator door systems may be customized to offer valuable solutions to existing needs and problems related to condensation and to waste of energy in commercial refrigerators. In the interest of clarity, not all of the routine features of the implementations of the insulated frame sections and refrigerator door systems are shown and described. In particular, combinations of features are not limited to those presented in the foregoing description as combinations of elements listed in the appended claims form an integral part of the present disclosure. It will, of course, be appreciated that in the development of any such actual implementation of the insulated frame sections and refrigerator door systems, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of refrigeration equipment having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. An insulated door, comprising:

two horizontal rails and two vertical rails, each of the two horizontal rails being in contact at its two extremities with extremities of the two vertical rails, each rail comprising:

an elongate interior side piece, an elongate exterior side piece, an elongate cover adapted to be mounted to the interior side piece, and an elongate rail insulation element positioned on an external edge of the rail, the rail insulation element linking the interior side piece to the exterior side piece, the rail insulation element preventing any direct physical contact between the interior and exterior side pieces; and a sealed glass unit (SGU) enclosed in a perimeter formed by the two horizontal rails and the two vertical rails, an outside face of the SGU being in contact with the exterior side pieces, an inside face of the SGU being in contact with the covers.

2. The door of claim 1, wherein at least one of the interior and exterior side pieces is made of a material having a first level of thermal conductivity and wherein the rail insulation element is made of a material having a second level of thermal conductivity, the first level of thermal conductivity being greater than the second level of thermal conductivity.

3. The door of claim 2, wherein a ratio of the first level of thermal conductivity over the second level of thermal conductivity is in a range between about 280 to about 2050.

4. The door of claim 2, wherein a ratio of the first level of thermal conductivity over the second level of thermal conductivity is in a range between about of 930 to about 2050.

5. The door of claim 1, wherein at least one of the interior side piece, exterior side piece and the rail insulation element is an extrusion.

6. The door of claim 1, wherein the rail insulation element is connected to the interior side piece and to the exterior side piece by dovetail joints.

7. The door of claim 1, wherein each rail further comprises an elongate gasket mounted on a side of the cover opposite from another side of the cover mounted to the interior side piece.

8. The door of claim 1, further comprising an adhesive filling at least in part spaces that surround edges of the SGU in areas of contact of the SGU with the rails.

9. The door of claim 8, further comprising an elongate cap inserted between the interior and exterior side pieces of each of the rails so to form, in each of the rails, a channel delimited by the interior side piece, the rail insulation element, the exterior side piece and the cap, the cap preventing the adhesive from entering into the channel.

10. The door of claim 1, wherein, in each rail, the interior side piece is spaced apart from the SGU.

11. The door of claim 1, wherein, in each rail, the rail insulation element is spaced apart from the cover.

12. The door of claim 1, wherein the rail insulation elements are positioned on the external edges of the rails to be opposite from edges of the SGU.

13. The door of claim 1, wherein, in each rail, the rail insulation element has a generally rectangular cross-section, two opposed ends of each rail being respectively connected to the interior side piece and to the exterior side piece.

14. A refrigerator door system, comprising:

a door frame comprising four frame sections assembled to form a rectangular opening; and an insulated door as claimed in claim 1, the insulated door being mounted to the door frame.

15. The refrigerator door system of claim 14, further comprising a pair of hinges adapted for mounting the door to the door frame.

16. The refrigerator door system of claim 15, wherein the hinges of the pair are respectively mounted to the two horizontal rails at a top and bottom of the door, the hinges of the pair being further connected to top and bottom horizontal frame sections of the door frame.

17. The refrigerator door system of claim 14, wherein each of the four frame sections of the door frame comprises:

an elongate interior frame member;

an elongate exterior frame member; and an elongate frame insulation element connected to the interior frame member and to the exterior frame member, the frame insulation element preventing any direct physical contact between the interior and exterior frame members.

* * * * *